US006928784B2

(12) United States Patent
Nordström et al.

(10) Patent No.: US 6,928,784 B2
(45) Date of Patent: Aug. 16, 2005

(54) BEAM ASSEMBLY IN A TARPAULIN HANDLING MACHINE

(75) Inventors: Lars-Ingvar Nordström, Lund (SE); Kent Stridh, Malmö (SE)

(73) Assignee: Lars-Ingvar Nordström, Lund (SE)

( * ) Notice: Subject to any disclaimer, the term of this patent is extended or adjusted under 35 U.S.C. 154(b) by 126 days.

(21) Appl. No.: 10/067,821

(22) Filed: Feb. 8, 2002

(65) Prior Publication Data

US 2002/0112440 A1 Aug. 22, 2002

(30) Foreign Application Priority Data

Feb. 9, 2001 (SE) ..... 0100403

(51) Int. Cl.[7] ..... E04C 3/30

(52) U.S. Cl. ..... 52/730.1; 160/243; 160/265; 160/328; 296/98; 296/100.15; 403/97

(58) Field of Search ..... 4/502; 34/121; 52/730.1, 730.3, 731.3, 739.1, 740.1; 160/243, 265, 328; 296/98, 100.15; 403/97

(56) References Cited

U.S. PATENT DOCUMENTS 4,116,745 A * 9/1978 Lambert ..... 156/362
4,203,174 A * 5/1980 Shults ..... 134/122 R
5,829,159 A * 11/1998 Hidgins et al. ..... 34/121
6,026,522 A * 2/2000 Last ..... 4/502

* cited by examiner

*Primary Examiner*—Carl D. Friedman
*Assistant Examiner*—Yvonne M. Horton
(74) *Attorney, Agent, or Firm*—Breiner & Breiner, L.L.C.

(57) ABSTRACT

A tarpaulin can be connected by clamp devices to a beam assembly for transfer of the beam through a tarpaulin handling machine. The beam assembly has a number of parallel, through beam rods and on each beam rod a number of beam tubes, which are alternatingly rigidly connected to a corresponding beam tube on a neighboring beam rod and are rotatable on the beam rod.

8 Claims, 4 Drawing Sheets

BEAM ASSEMBLY IN A TARPAULIN HANDLING MACHINE

TECHNICAL FIELD

The present invention relates to a beam assembly, to which a tarpaulin can be connected for its transfer through a tarpaulin handling machine.

BACKGROUND OF THE INVENTION

Tarpaulins are used for a variety of purposes, where they are exposed to wear, tear and dirty environments. Tarpulins are often very big and heavy, and a tendency towards even bigger sizes may be noted, for example tarpaulins with a width of 8 m or more and a length of 20 m or more.

There is a need to handle tarpaulins for washing or cleaning or for inspecting them on large backlit surfaces. In washing machines or inspection machines, the tarpaulin may be attached or connected by means of clamp devices to a beam assembly, which moves the tarpaulin mechanically through the machine.

The basic requirements on such a beam assembly is that it shall be able to carry the great weight of the tarpaulin (for example 600 kg or more) without excessive deflection, at the same time as it shall have the ability to move in the machine and thereby to bend at a direction change.

THE INVENTION

These requirements may according to the invention be fullfilled by a beam assembly that comprises a number of parallel, through beam rods and on each beam rod a number of beam tubes, which are alternatingly rigidly connected to a corresponding beam tube on a neighboring beam rod and are rotatable on the beam rod.

Preferably, each beam rod, which extends over the width of the machine, is at each end provided with an attachment pin for a chain or the like to be laid over sprockets or the like in the machine, so that the beam assembly may be transferred through the machine.

In a practical case beam tubes from neighboring beam rods are rigidly connected two and two by means of welded strips. Connection pieces, each for connecting two beam rods which are not connected by beam tube strips, are further arranged towards the ends of the beam rods.

The result is a beam assembly, in which the forces are evenly distributed on the different beam rods but which still can bend like a chain over sprockets in a tarpaulin handling machine.

The horizontal forces in the design may be handled by rings that are arranged between adjacent beam tubes on each beam rod and between each connection piece and the adjacent beam tube, respectively.

In a practical case, the clamp devices for connecting the tarpaulin are attached to two parallel clamp device tubes below the lowermost beam rod, said tubes being connected at each end by an end piece, which is provided with attachment pins corresponding to the attachment pins on the beam rods. Each lowermost beam tube, which is not connected to its neighboring beam tube by means of a welded strip, has loops for rotatable connection to the upper clamp device tube.

BRIEF DESCRIPTION OF THE DRAWINGS

The invention will be described in further detail below under reference to the accompanying drawings, in which.

DETAILED DESCRIPTION OF A PREFERRED EMBODIMENT

Figure 1:
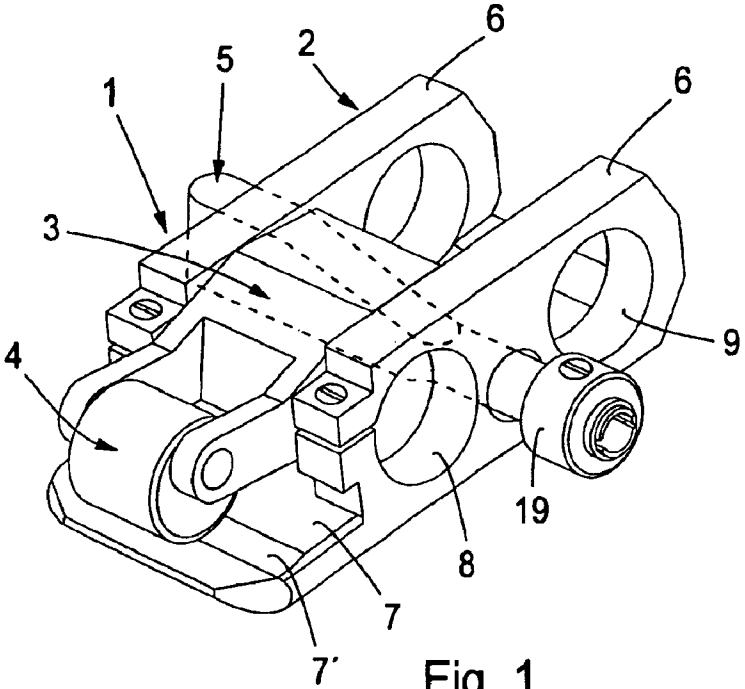
FIG. 1 is a perspective view of a clamp device, especially for a tarpaulin, with a control member therefore.
Figure 2:
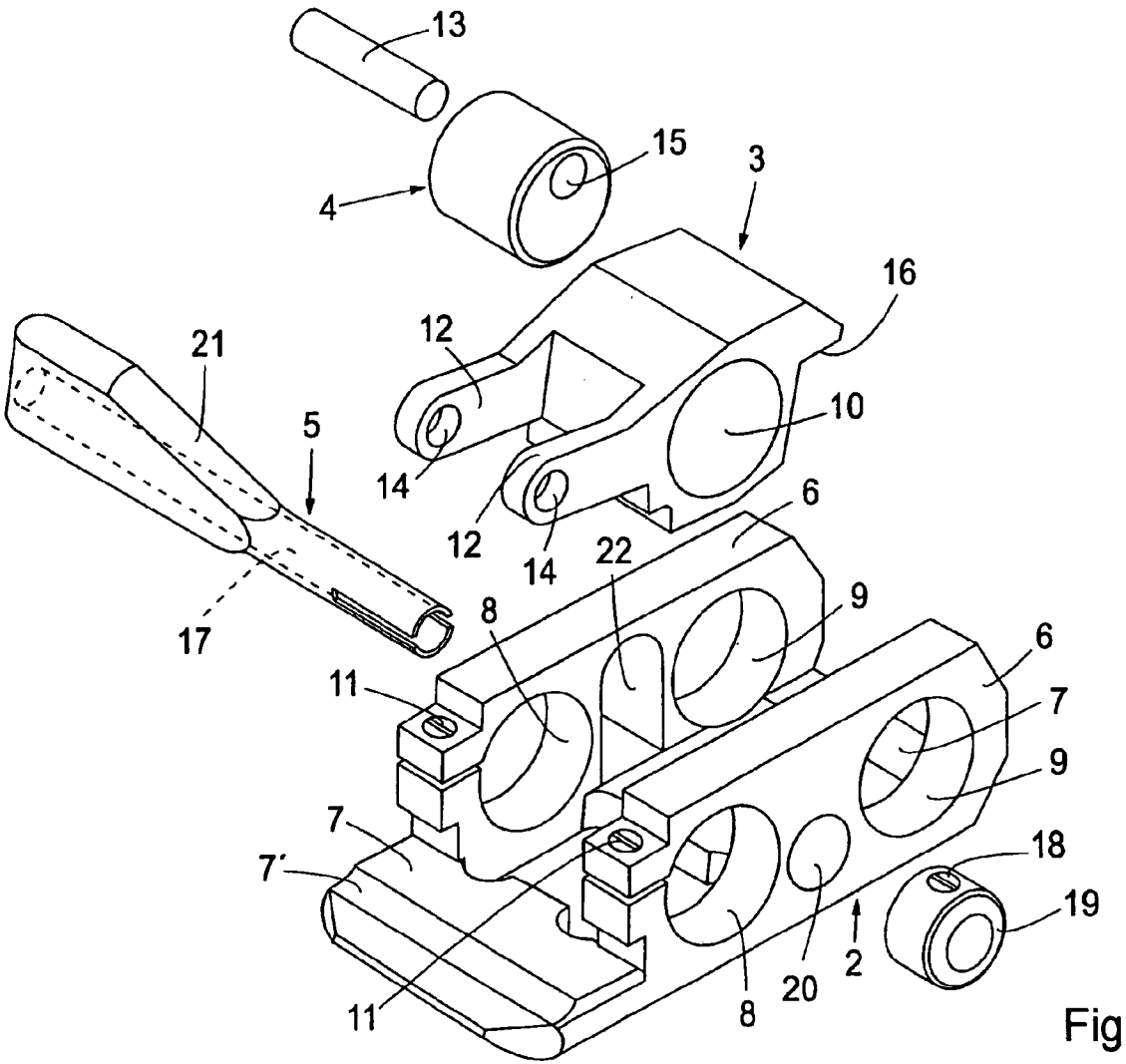
FIG. 2 is an exploded view of the same device to a larger scale.

A clamp device 1 is shown in FIG. 1 in an assembled condition and in FIG. 2 to a larger scale and in an exploded view. In FIG. 1 its position is open.

The clamp device 1 has basically a body 2, a clamp arm 3 pivotally arranged in relation thereto, a roller 4 rotatably attached in the clamp arm 3, and an axially movable control member 5.

The body 2 has two sidewalls 6 and a bottom 7, which in the practical case is partly open. The sidewalls have two pairs of coaxial bores 8 and 9 for tubes to be described. The clamp arm 3 has a through bore 10 with substantially the same diameter as the sidewall bores 8. A tube inserted through the bores 8 and the clamp arm bore 10 will act as a pivot for the clamp arm 3. A lip-shaped portion of the bottom 7 extending forward past the sidewalls 8 has a transverse, part-cylindrical groove 7', which is coaxial with the roller 4 and has substantially the same radius as the latter. The sidewalls 6 are as shown slotted adjacent to the bores 8, so that the body 2 can be fastened by a clamping force excerted by screws 11 to a tube inserted in the bores 8.

The clamp arm 3 has two yokes 12 extending forward or to the left in FIGS. 1 and 2, and the roller 4 may be rotatably attached to the yokes 11 by means of a shaft 13 in yoke holes 14 and in an eccentrically positioned through hole 15 in the roller 4.

In its portion extending to the right in FIGS. 1 and 2 the clamp arm 3 has a shoulder 16 for cooperation with the axially movable control member 5. The control member 5 has a through bore 17 (FIG. 2) for a control rod to be described. The control member 5 is cylindrical to the right in FIG. 2 and is there slotted, so that it may be attached to the control rod by means of a screw 18 in an attachment ring 19. One of the sidewalls 6 has a through hole 20 for the cylindrical part of the control member 5.

The remaining part of the control member 5 has a generally parallelepipedical shape with an inclined land 21 for cooperation with the clamp arm shoulder 16. The parallelepipedical part of the control member 5 is guided for axial movement only by a through opening 22 with a corresponding shape in the other sidewall 6.

When moved to the right in FIGS. 1 and 2, the control member 5 will engage the clamp arm shoulder 16 by means of its inclined land 21 and move the clamp arm yokes 12 with the roller 4 towards the bottom 7, which may also be called a base member.

Figure 3:
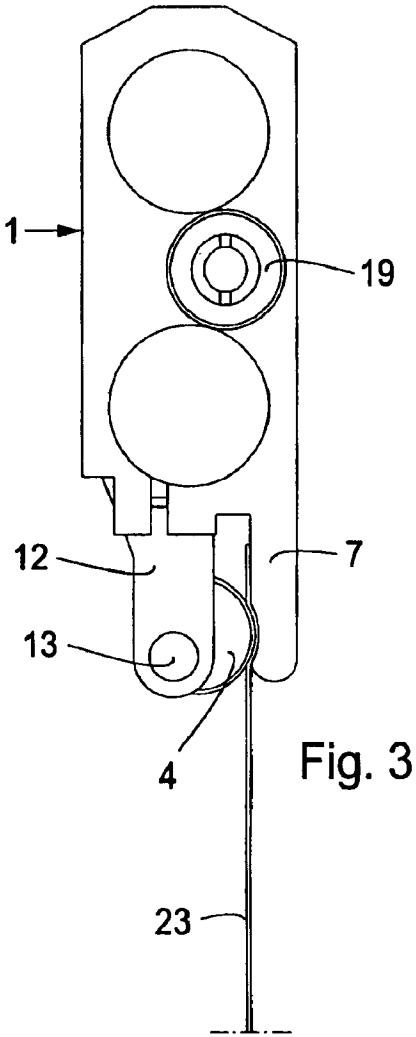
FIG. 3 is a side view of the clamp device in a closed position holding a tarpaulin.

In this condition, shown in FIG. 3, the roller 4 is applied against the bottom groove 7' with a force caused by its eccentricity and its weight. The edge of a tarpaulin 23 may be inserted practically without resistance between the roller 4 and the bottom 7 but when let loose will be securely clamped to the bottom 7 by the eccentricity of the roller 4 under the action of the tarpaulin weight. The engagement may be further improved in that the circumferential surface of the roller 4 is knurled, serrated or corrugated.

Figure 4:
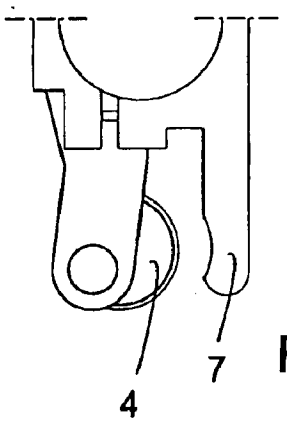
FIG. 4 is a corresponding side view of a portion of the clamp device in an open position.

When it is desired to release the tarpaulin 23, the control member 5 is moved to the left in FIGS. 1 and 2, so that the control arm 3 is free to move to its open position shown in FIG. 4, where the roller 4 no longer is in engagement with the bottom groove 7'. Hereby, a clamping force is no longer applied to the tarpaulin 23.

Figure 5:
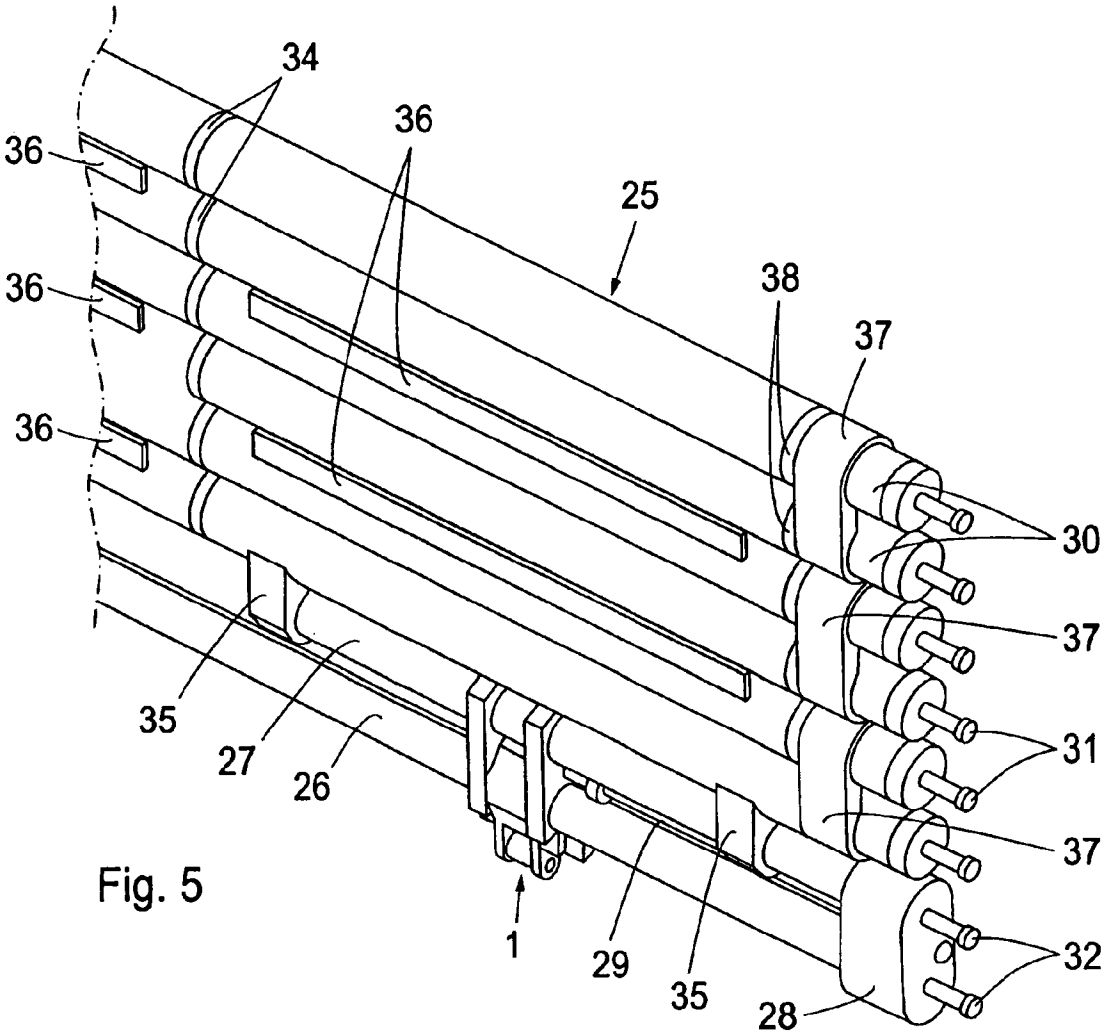
FIG. 5 is a perspective view of a portion of a flexible beam assembly, provided with clamp devices of FIG. 1.
Figure 6:
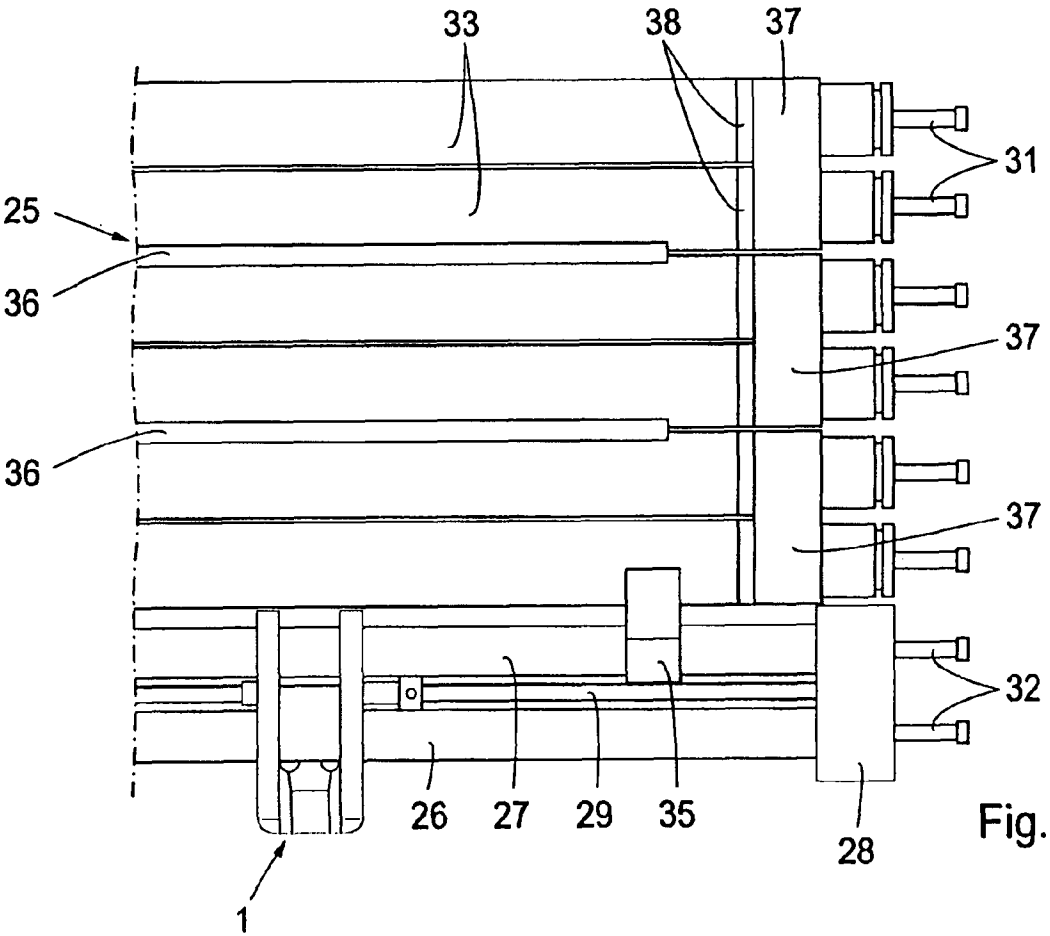
FIG. 6 is a plan view of the beam assembly of FIG. 5.
Figure 7:
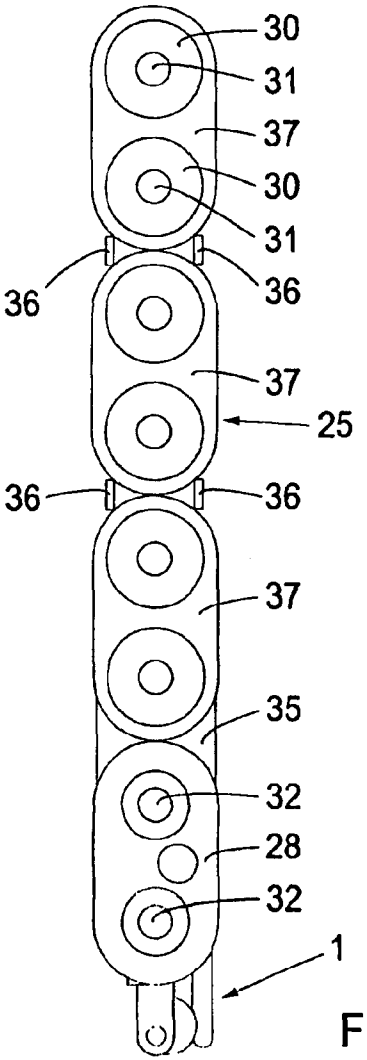
FIG. 7 is a side view of the beam assembly of FIG. 5 to a larger scale.

A beam assembly 25 is shown in FIGS. 5–7. The purpose of this beam assembly is to be rigid enough to withstand bending under the weight of a large tarpulin with a width of 8 m or even more and a length of 20 m or more and still be flexible for allowing movement around sprockets of a tarpaulin washing or inspection machine.

In its lower part the beam assembly 25 has two clamp device tubes 26 and 27 for mounting the clamp devices 1. The clamp devices 1, of which only one is shown in each of the FIGS. 5–7, are preferably evenly distributed along the length of the beam assembly 25, and their number depends on the beam assembly length. In a practical case, however, the number is twelve.

The lower clamp device tube 26 extends through the bores 8 of the clamp devices 1 and the clamp arm bores 10, whereas the upper tube 27 extends through the clamp device bores 9. At each end the two tubes 26 and 27 are connected by means of an end piece 28.

A control rod 29 extends from the end piece 28 between the two clamp device tubes 26 and 27. The different control members 5 of the clamp devices 1 are attached to this control rod 29, which may be axially transferred by means (not shown) in the end piece 28 for accomplishing a concurrent opening and closing function of all the clamp devices 1 as described above.

The beam assembly 25 further comprises a number of through beam rods 30 (which may in fact be tubular or hollow). In the shown example the number of such rods is six. At each end each rod is provided with an attachment pin 31 for a chain (not shown) to be laid over sprockets in the tarpaulin washing or inspection machine. Corresponding attachment pins 32 are arranged on the end pieces 28.

Beam tubes 33 are threaded over the beam rods 30 in a way to be described. Rotational movements are admitted between the beam rods 30 and the beam tubes 33, and the beam tubes 33 may be provided with means (not shown) for introducing lubricant between the rods and the tubes.

The length of each beam tube 33 is limited. In the example with twelve clamp devices 1, there may be twelve beam tubes 33 to cover the entire length of each beam rod 30. Rings 34 for handling horisontal forces are preferably arranged between adjacent beam tubes 33.

In the beam assembly section shown in FIG. 5 the first or lowermost beam tube 33 is connected to the upper clamp device tube 27 by means of two loops 35, one at each side of the clamp device 1. The second and third beam tubes 33 are connected by means of welded strips 36, which also applies for the fourth and fifth tubes. The sixth and uppermost tube 33 is not connected to any other tube. In the chosen example, the above description is true also for sections three, five, seven, and so forth, i.e. each section with a clamp device 1.

Further, beam rods one and two; three and four; and five and six are mutually connected by means of connection pieces 37 at each end. Rings 38 for handling horisontal forces are provided between the respective beam tubes 33 and the connection pieces 37.

In the second section, which is shown to the left in FIG. 5, beam tubes one and two; three and four; and five and six are respectively connected by means of welded strips 36. The first or lowermost beam tube 33 is not connected to the upper clamp device tube 27. The same arrangement is made also for section four, six, eight, and so forth.

By the shown and described design the forces from the weight of the carried tarpaulin, which may amount to for example 600 kg, are evenly distributed over the different rods and tubes in the beam assembly with a considerable height, at the same time as the beam assembly will be flexible enough to act as a chain at passing over sprockets in the tarpaulin washing or inspection machine.

What is claimed is:

1. A beam assembly in combination with a tarpaulin handling machine, wherein the beam assembly comprises a number of parallel beam rods and on each beam rod a number of beam tubes, which are alternatingly rigidly connected to a corresponding beam tube on a neighboring beam rod and are rotatable on the beam rod, wherein said beam assembly is constructed and arranged for connection to a tarpaulin for transfer of the tarpaulin through the tarpaulin handling machine.

2. An assembly according to claim 1, wherein each beam rod, which extends over the width of the machine, at each end is provided with an attachment pin for a chain to be laid over sprockets in the machine, so that the beam assembly is transferrable through the machine thereby.

3. An assembly according to claim 1, wherein said beam tubes from neighboring beam rods are rigidly connected two and two by means of welded strips.

4. A beam assembly constructed and arranged for connection to a tarpaulin for transfer of the tarpaulin through a tarpaulin handling machine, comprising a number of parallel beam rods and on each beam rod a number of beam tubes, which are alternatingly rigidly connected to a corresponding beam tube on a neighboring beam rod and are rotatable on the beam rod, wherein said beam tubes from neighboring beam rods are rigidly connected two and two by means of welded strips, and wherein connection pieces, each for connecting two beam rods which are not connected by beam tube strips, are arranged towards ends of the beam rods.

5. An assembly according to claim 4, wherein rings are arranged between adjacent beam tubes on each beam rod and between each connection piece and an adjacent beam tube, respectively.

6. An assembly according to claim 4, wherein clamp devices for connecting the tarpaulin are attached to two parallel clamp device tubes below the lowermost beam rod, said tubes being connected at each end by an end piece, which is provided with attachment pins corresponding to attachment pins on the beam rods.

7. An assembly according to claim 6, wherein each lowermost beam tube, which is not connected to a neighboring beam tube by means of a welded strip, has loops for rotatable connection to an upper clamp device tube.

8. An assembly according to claim 6, wherein a control rod for the clamp devices extends between the two clamp device tubes.

* * * * *